US009051626B2

(12) United States Patent
Lalancette et al.

(10) Patent No.: US 9,051,626 B2
(45) Date of Patent: Jun. 9, 2015

(54) METHOD AND A SYSTEM FOR GOLD EXTRACTION WITH HALOGENS

(75) Inventors: Jean-Marc Lalancette, Sherbrooke (CA); Bertrand Dubreuil, Trois-Rivieres (CA); David Lemieux, Thetford Mines (CA)

(73) Assignee: DUNDEE, TECHNOLOGIES DURABLES INC., Montreal (CA)

( * ) Notice: Subject to any disclaimer, the term of this patent is extended or adjusted under 35 U.S.C. 154(b) by 213 days.

(21) Appl. No.: 13/418,863

(22) Filed: Mar. 13, 2012

(65) Prior Publication Data

US 2013/0074655 A1 Mar. 28, 2013

Related U.S. Application Data

(60) Provisional application No. 61/539,517, filed on Sep. 27, 2011.

(51) Int. Cl.

| | |
|---|---|
| ***C22B 11/06*** | (2006.01) |
| ***C22B 3/10*** | (2006.01) |
| ***C22B 3/04*** | (2006.01) |
| ***C22B 3/06*** | (2006.01) |

(52) U.S. Cl.
CPC ..... *C22B 11/06* (2013.01)

(58) Field of Classification Search
CPC ..... C22B 11/04; C22B 13/04; C22B 3/10; C22B 11/06; C22B 13/00; C22B 13/02; C22B 13/06
USPC ..... 75/744, 743
See application file for complete search history.

(56) References Cited

U.S. PATENT DOCUMENTS

| | | | | |
|---|---|---|---|---|
| 649,962 | A | 5/1900 | Smith et al. | |
| 3,819,504 | A * | 6/1974 | Bennett | 204/289 |
| 4,342,592 | A | 8/1982 | Lamb | |
| 7,537,741 | B2 | 5/2009 | Lalancette | |

(Continued)

FOREIGN PATENT DOCUMENTS

| | | |
|---|---|---|
| CA | 2448999 | 8/2004 |
| CA | 2642618 | 8/2007 |
| CA | 2636122 | 9/2009 |

(Continued)

OTHER PUBLICATIONS

Baglin et al. Recovery of Platinum, Palladium, and Gold from Stillwater Complex Flotation Concentrate by a Roasting-Leaching Procedure. Report of Investigations—United States. Bureau of Mines 1985.

(Continued)

*Primary Examiner* — Jie Yang
*Assistant Examiner* — Xiaowei Su
(74) *Attorney, Agent, or Firm* — Goudreau Gage Dubuc; Gwendoline Bruneau

(57) ABSTRACT

The invention relates to a method for the extraction of precious metals, using halogens. It has been found that introducing halogens in the reactor in the form of hypohalites rather than free halogens simplified greatly the recycling of halogens by electrolysis. It increases the rate of addition of the halogens and significantly reduces secondary reactions with base metals such as iron. Operating under acidic conditions, the gold recovery has been found as high with hypochlorite as with elemental chlorine, with an active chlorine to ore ratio reduced by a factor of two to five.

7 Claims, 2 Drawing Sheets

(56) References Cited

U.S. PATENT DOCUMENTS

| | | | | |
|---|---|---|---|---|
| 2008/0112864 | A1* | 5/2008 | Lalancette | 423/40 |
| 2009/0013829 | A1* | 1/2009 | Harris et al. | 75/710 |

FOREIGN PATENT DOCUMENTS

| | | | |
|---|---|---|---|
| CN | 102002600 | A | 11/2010 |
| GB | 795790 | | 5/1958 |
| WO | 0242503 | | 5/2002 |
| WO | 2004059018 | | 7/2004 |
| WO | 2012149631 | A1 | 11/2012 |
| WO | 2013044380 | A1 | 4/2013 |

OTHER PUBLICATIONS

Yen et al. Hypochlorite leaching of gold ore. Advances in Gold Silver Processing: Reno, Nevada, USA, Sep. 10-12, 1990, pp. 67-74.

International Search Report from co-pending PCT application No. PCT/CA2012/050617.

Advanced Inorganic Chemistry, A. Cotton and G. Wilkinson, Interscience Publishers, 1972, p. 476.

Oxidation Potential, W.M. Latimer, Prentice-Hall, 1952, pp. 56 and 62.

International Search Report of PCT No. PCT/CA2014/050217 mailed on Nov. 25, 2014.

* cited by examiner

METHOD AND A SYSTEM FOR GOLD EXTRACTION WITH HALOGENS

CROSS REFERENCE TO RELATED APPLICATIONS

This application claims benefit of U.S. provisional application Ser. No. 61/539,517, filed on Sep. 27, 2011. All documents cited herein are incorporated herein in their entirety by reference.

FIELD OF THE INVENTION

The present invention relates to gold and silver extraction with halogens. More precisely, it relates to a method and a system for gold extraction with halogens recycling.

BACKGROUND OF THE INVENTION

It has been reported (U.S. Pat. No. 7,537,741) that gold/silver-bearing ores, after being deprived of most of their base metals such as Cu, Zn, Fe and chalcogens such as sulfur and tellurium, can be treated very efficiently with halogens for precious metals recovery. The ore is slurried in a brine of sodium chloride incorporating a minor portion of sodium bromide, and elemental chlorine is then admitted to the system at near ambient temperature (40-50° C.). The high oxidation potential of the chlorine leads to the formation of some bromine from the bromide in the slurry, and the mixed halogens (chlorine, bromine) lead to a fast (a few hours) and rather complete precious metals recovery. This process is a closed loop approach, which means that the brine, after separation from the barren solution and precious metal recovery, is used as a source of elemental chlorine. This production of chlorine is done by the electrolysis of the brine in a standard electrolytic cell with either a membrane or a diaphragm for the separation of the cathodic compartment from the anodic one.

This method is submitted to significant limitations when implemented. First, the brine collects many types of ions in the course of the gold extraction, particularly elements of the alkaline earth group, such as calcium and magnesium. As state of the art materials used as diaphragms or membranes are highly sensitive to these contaminants, extensive purification of the brine is thus required prior to electrolysis. Secondly, the solubility of chlorine in water is rather low, 0.091 mole/l at 25° C. (Advanced Inorganic Chemistry, A. Cotton and G. Wilkinson, Interscience Publishers, 1972, p. 476). This solubility is further decreased if a brine of NaCl rather than pure water is used. Chlorine addition requires periods of time counted in hours rather than minutes. In turn, finally, this long addition time leads to secondary reactions of chlorine and bromine with remaining base metals in the ore, mainly iron, and with sulfur as sulphide, thus increasing the overall consumption of halogens.

There thus remains a need for an improved method and system for precious metals extraction by the halogens allowing recycling halogens.

SUMMARY OF THE INVENTION

More specifically, in accordance with the present invention, there is provided a method for extracting precious metals from ore, comprising, in a reactor, slurrying the ore in the salt brine, acidifying the slurried ore and contacting the acidic slurried ore with halogens, said halogens being fed to the reactor in the form of hypohalites.

There is further provided a system for extracting precious metals from ore, comprising a diaphragm-less electrolytic cell; a leaching reactor; and a brine reservoir, the brine reservoir feeding the diaphragm-less electrolytic cell and the leaching reactor; and the leaching reactor receives the ore, brine from the brine reservoir, hypohalite generated in the diaphragm-less electrolytic cell, and an acid.

There is provided a method of gold and silver extraction from ore in a reactor, using diluted hypochlorites as a source of active chlorine, comprising controlling the pH of slurried ore in a range between 0.5 and 3, and adding hypochlorites in an amount sufficient to raise the oxido-reduction potential of the reactor in a range comprised between about 0.7 and about 1.2 V vs a Ag/AgCl reference electrode.

Other objects, advantages and features of the present invention will become more apparent upon reading of the following non-restrictive description of specific embodiments thereof, given by way of example only with reference to the accompanying drawings.

DESCRIPTION OF EMBODIMENTS OF THE INVENTION

Figure 1:
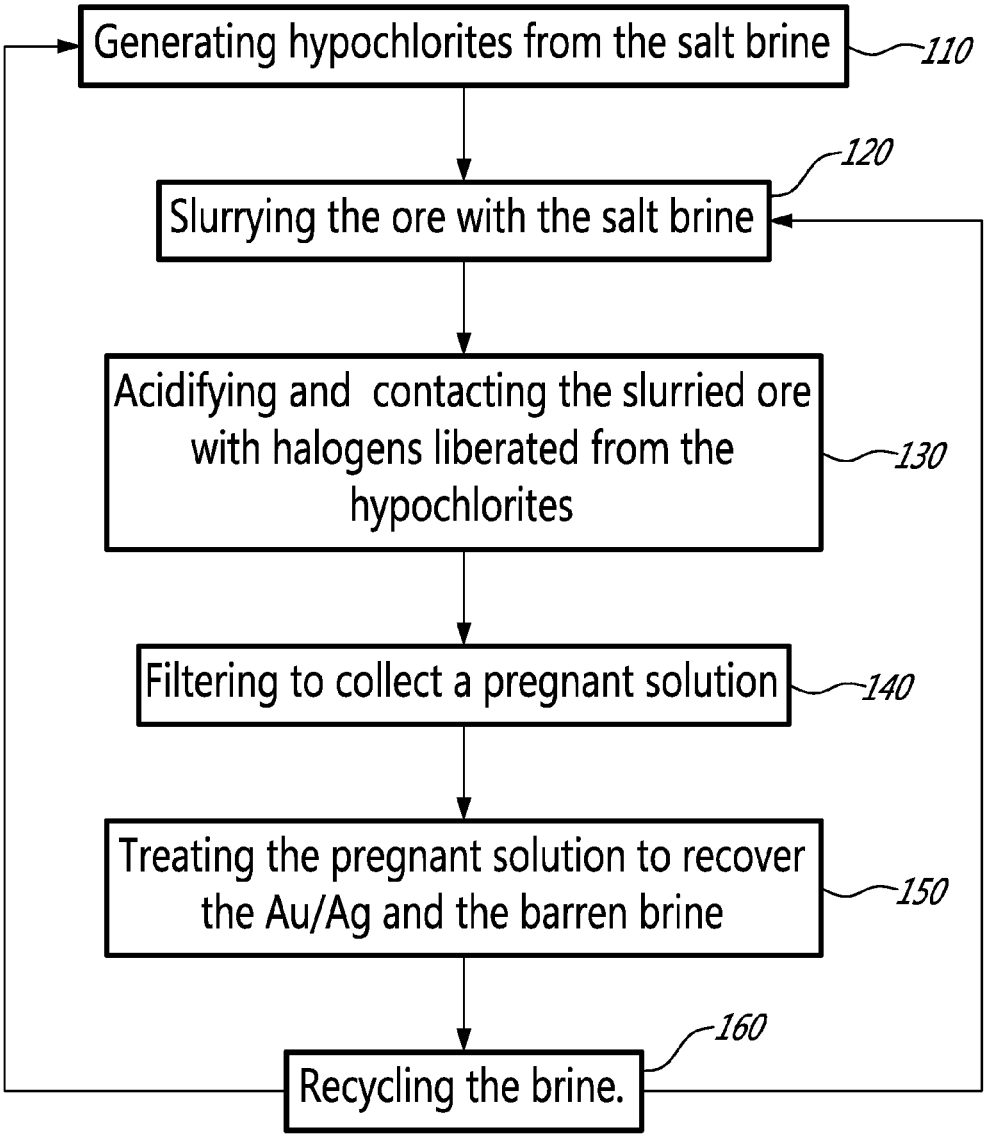
FIG. 1 is a flowchart of a method according to an embodiment of an aspect of the present invention.

There are known methods for the production of hypohalites, such as hypochorites (NaOCl) and hypobromites (NaOBr), by electrolysis of brine. For example, the company Siemens commercializes a system called OSEC® B-Pak generating a sodium hypochlorite solution through the electrolysis of brine, using an electrolytic cell devoid of membrane or diaphragm, and wherein the catolytic and anolytic solutions are mixed inside the cell to give corresponding hypohalites, NaOCl or NaOBr. These hypohalites are very soluble in water, and, in the case of NaOCl, they may be used at concentrations in the range of 0.5 to 1.0% for the purification of drinking water.

Surprisingly, it was found, in the present invention, that the use of diluted hypochlorites as a source of active chlorine was very efficient for gold and silver extraction, providing the pH of the slurried ore in the reactor is acidic, in a range between 0.5 and 3, and providing the added hypochlorites raised the oxido-reduction potential (ORP) of the system to about 0.85 V (Ag/AgCl reference). There is no need of complex, full-fledged compartmented electrolytic cells. Moreover, the rate of addition of active chlorine is greatly improved due to the high solubility of hypohalites, and secondary reactions with iron and sulfides are much decreased.

The production of hypochlorites (NaOCl) from salt brine can be described by the following equations (I):

$$\text{Cathode } 2Na^{+}+2e^{-}\rightarrow 2Na$$

$$2Na+2H_2O\rightarrow 2\ NaOH+H_2$$

$$\text{Anode } 2Cl^{-}\rightarrow Cl_2+2e^{-}$$

$$\text{Mixing } 2NaOH+Cl_2\rightarrow NaCl+NaOCl$$

Similar equations can be written for the production of hypobromites (NaOBr).

With a diaphragm-less cell, concentration of active chlorine, that is hypochlorites (NaOCl), at the level of 0.5 to 2.0% of active chlorine can be achieved, with equipment sold commercially for water purification for example.

The hypochlorite solution (NaOCl) can oxidize the bromide ion to elemental bromine (Oxidation Potential, W. M. Latimer, Prentice-Hall, 1952, pp. 56 and 62). Therefore, sodium hypochlorite can generate, in the reactor, the bromine required for gold extraction from the slurried ore. Also, the addition of the sodium hypochlorite is done in a slurry which is made acidic with an acid such as sulfuric acid, for example. Besides eliminating the carbonates that might be present in the ore, this acidic addition displaces the equilibrium of the hypochlorite/water system towards the liberation of free chlorine, as illustrated by the following equations (II):

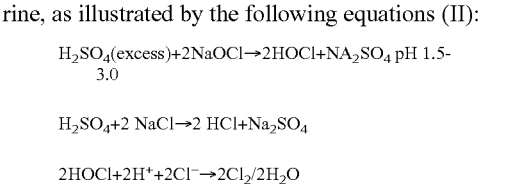

$$H_2SO_4(\text{excess})+2NaOCl \rightarrow 2HOCl+NA_2SO_4 \text{ pH } 1.5\text{-}3.0$$

$$H_2SO_4+2\ NaCl \rightarrow 2\ HCl+Na_2SO_4$$

$$2HOCl+2H^+ +2Cl^- \rightarrow 2Cl_2/2H_2O$$

(Cotton and Wilkinson, Ibid., p. 476.)

In the present invention, very soluble hypochlorites are used as an intermediate form of active halogen used for recycling halogens, the free halogens being recovered in the reaction cell, under acidic conditions. The amount of hypohalite required to obtain a rapid and near-complete lixiviation of precious metals from the ore has been found to be of the order of one percent of the weight of the slurried ore, the corresponding ORP being in the range of 0.75 to 1.0 V, for example of 0.85 V.

This situation represents a very significant improvement over the direct chlorination with elemental chlorine, where the ratio of chlorine to ore was from 2% to 10%. Also, a significant decrease of the consumption of active chlorine by base metals in the ore, typically mostly iron, has been noted.

Those results are illustrated by the following examples.

Example 1

A gold ore showing the following analysis: 2.6 g/t Au, 1.2 g/t Ag, 5.0% Fe, 0.4% $S^{2-}$ and ground to 80% minus 120 mesh was slurried (35% solid) in a brine 7% NaCl and 2% NaBr, the temperature being 40° C. The chlorination was done in two different ways: i) with direct chlorination with elemental chlorine, and ii) by addition of sodium hypochlorite as a source of active halogen.

The following Table I gives comparative results.

TABLE I

| Halogen carrier | Duration (h) | pH (initial) | Ratio (W/W) Active Cl/ore | Fe Dis-solved (%) | ORP (mV) | Au Recovery (%) |
|---|---|---|---|---|---|---|
| direct chlorination $Cl_2$ | 4 | 6 | 10/100 | 50 | — | 97 |
| addition of sodium hypochlorite NaOCl | 2 | 0.5 | 2/100 | 23 | 953 | 98 |

Example 2

The same gold ore (200 g) as in Example 1 was slurried in a brine (100 g/L NaCl and 30 g/L NaBr) giving 30% solid content. The slurried ore was stirred at 40° C. for four hours and hypochlorite NaOCl 12% was added so as to have a 0.5% NaOCl concentration. Then, variable acidic ($H_2SO_4$) addition was done, yielding 5 different systems, with different ORP. Results are shown in the following Table II.

TABLE II

| Condition Acid addition ($H_2SO_4$) | pH (end) | ORP (mV) | Au Recovery (%) |
|---|---|---|---|
| 1 | 6.2 | 445 | 35 |
| 2 | 5.7 | 714 | 87 |
| 3 | 5.5 | 824 | 94 |
| 4 | 2.5 | 822 | 97 |
| 5 | 1.5 | 913 | 98 |

As clearly seen from these examples, an increase in acidity, as shown by pH decrease, corresponds to an accelerated halogen release and improved gold recovery.

A method according to an embodiment of an aspect of the present invention, as shown in the flowchart of FIG. 1 for example, comprises generating hypochlorites from a salt (NaCl and NaBr) brine (step 110); slurrying the ore with the salt (NaCl and NaBr) brine (step 120); performing chlorination by addition of hypochlorites under acidic conditions (step 130); filtering to collect a pregnant solution (step 140); treating the pregnant solution to recover the Au/Ag on the one hand (step 150) and the barren brine on the other hand (step 160).

Figure 2:
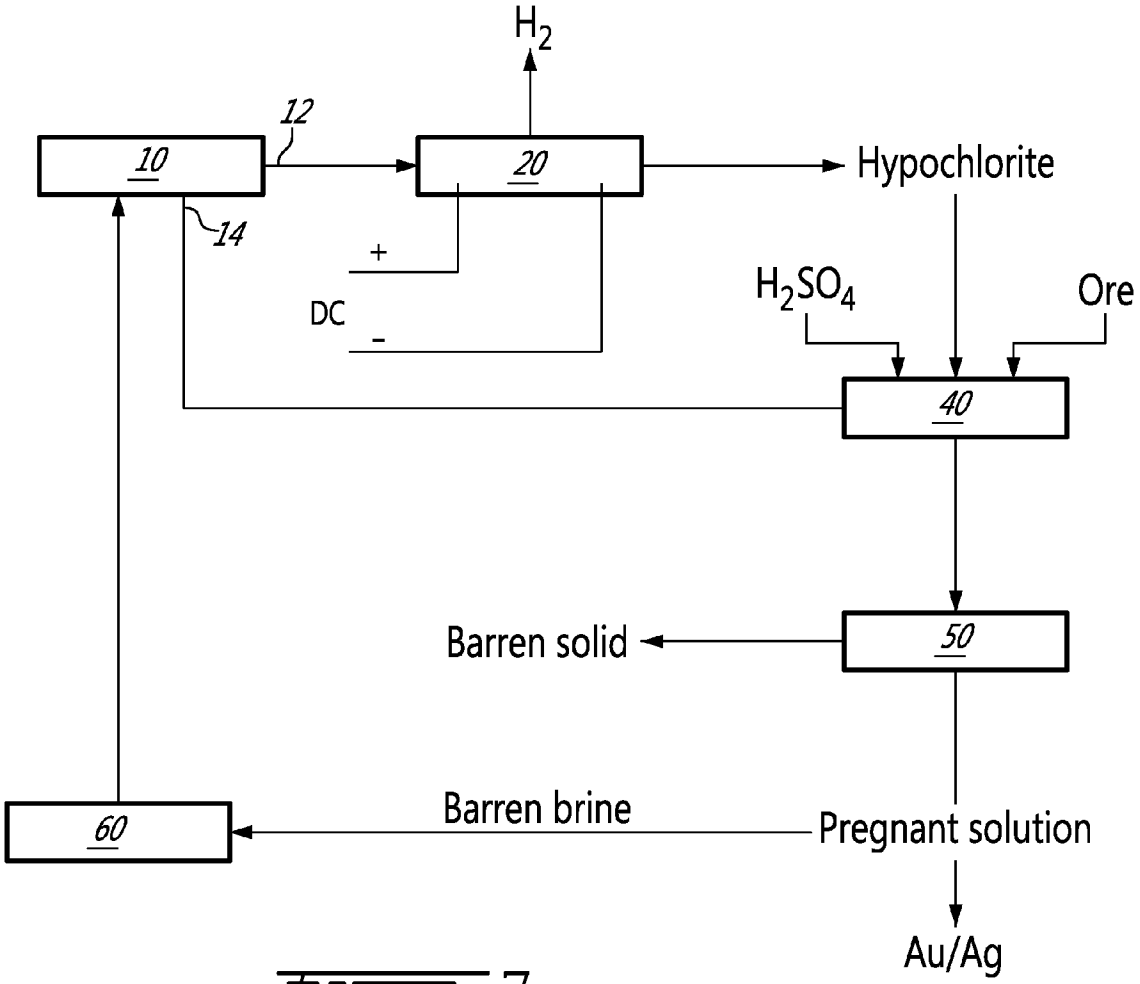
FIG. 2 is a schematic view of a system of a system according to an embodiment of an aspect of the present invention.

A system according to an embodiment of the present invention, as illustrated for example in FIG. 2, comprises a brine reservoir 10. An first outlet 12 of the brine reservoir 10 is directed to a diaphragm-less electrolytic cell 20 and a second outlet 14 of the brine reservoir 10 is directed to a leaching reactor 40. Hypohalite is generated (see equations I above) in the diaphragm-less electrolytic cell 20. In the leaching reactor 40, the ore is slurried with the brine from the brine reservoir 10, acidified with sulphuric acid or hydrochloric acid and contacted with halogens liberated from the hypochlorite generated in the diaphragm-less electrolytic cell 20. After a contact time of a few hours, the reaction mass in the vat leaching reactor 40 is filtered (filter 50) into a barren solid, which is discarded, and a pregnant solution, which is treated for collection of Au/Ag. The barren brine is then purified from the base metals collected by pH adjustment and filtration (60) and recycled to the brine reservoir 10 for further use.

There is thus provided a system and a method for the extraction of precious metals by halogens ($Cl_2$, $Br_2$) where the halogens are recycled to the leaching reactor in the form of hypohalites. The formation of hypohalites is achieved by the electrolysis of brine in a diaphragm-less cell. The solution of recycled hypohalites is fed to an acidic slurry of the ore in the leaching reactor, the pH of the slurry being leached being between 0.5 and 3, with a preferred value of 1.5, and the ORP in the reactor is in the range of 0.7 to 1.2 V (Ag/AgCl reference electrode), with a preferred value of 0.85. The hypohalite may be NaOCl as active halogen, or NaOBr as active halogen, or a mixture of both hypohalites, in an amount between about 0.5 and 2 percent of the ore. A preferred concentration of NaOCl is 1.5%.

Although the present invention has been described hereinabove by way of embodiments thereof, it may be modified, without departing from the nature and teachings of the subject invention as recited herein.

What is claimed is:

1. In a method for extracting precious metals from ore using halogens:

adding a mixture of hypohalites to an acidic slurry of the ore, a pH of the slurry being comprised in a range between 0.5 and 3, under an oxido-reduction potential in a range comprised between about 0.7 and about 1.2 V vs a Ag/AgCl reference electrode;

filtering to collect a pregnant solution;

treating the pregnant solution to separate the precious metals from a barren salt brine; and recycling halogens from the barren salt brine in the form of hypohalites formed by electrolysis of the barren salt brine in a diaphragm-less cell.

2. The method of claim 1, wherein the pH of the slurry is about 1.5.

3. The method of claim 2, wherein the oxido-reduction potential is about 0.85 V.

4. The method of claim 1, wherein said adding a mixture of hypohalites comprises adding a mixture of hypohalites in a range comprised between about 0.5 and about 2 weight percent of the ore.

5. The method of claim 1, wherein the slurry of the ore has a temperature of about 40° C.

6. The method of claim 1, comprising adding the hypohalites at a concentration of 1.5 weight % of the ore.

7. The method of claim 1, wherein said precious metals are gold and silver.

* * * * *